US009174260B2

(12) United States Patent
Yuasa

(10) Patent No.: US 9,174,260 B2
(45) Date of Patent: Nov. 3, 2015

(54) HOT PRESS PRODUCT AND METHOD OF FORMING THE SAME

(71) Applicant: TOPRE CORPORATION, Chuo-Ku, Tokyo (JP)

(72) Inventor: Naoya Yuasa, Kanagawa (JP)

(73) Assignee: Topre Corporation, Tokyo (JP)

( * ) Notice: Subject to any disclaimer, the term of this patent is extended or adjusted under 35 U.S.C. 154(b) by 208 days.

(21) Appl. No.: 13/860,734

(22) Filed: Apr. 11, 2013

(65) Prior Publication Data

US 2013/0316132 A1 Nov. 28, 2013

(30) Foreign Application Priority Data

May 28, 2012 (JP) ..... 2012-120505
Feb. 13, 2013 (JP) ..... 2013-025162

(51) Int. Cl.
*B21D 22/02* (2006.01)
*B21D 22/04* (2006.01)
*B21D 43/00* (2006.01)

(52) U.S. Cl.
CPC ..... *B21D 22/022* (2013.01); *B21D 22/04* (2013.01); *B21D 43/003* (2013.01); *Y10T 428/24281* (2015.01)

(58) Field of Classification Search
CPC ..... B21D 22/02; B21D 22/022; B21D 22/04; B21D 22/06; B21D 28/04; B21D 37/12; B21D 43/003; Y10T 428/24281
USPC ..... 72/325, 332, 342.1, 347
See application file for complete search history.

(56) References Cited

U.S. PATENT DOCUMENTS 2,157,354 A * 5/1939 Sherman ..... 72/349
2,859,510 A * 11/1958 Baxa ..... 29/890.051
3,668,917 A * 6/1972 Komatsu et al. ..... 72/342.3
3,837,241 A * 9/1974 Weiss ..... 76/112
4,077,247 A * 3/1978 Stewart ..... 72/325
4,674,314 A * 6/1987 McGregor, Jr. ..... 72/355.4
7,757,536 B2 * 7/2010 Ichikawa et al. ..... 72/420

FOREIGN PATENT DOCUMENTS

JP 2008221284 A 9/2008

* cited by examiner

*Primary Examiner* — Edward Tolan
(74) *Attorney, Agent, or Firm* — Kilpatrick Townsend & Stockton LLP

(57) ABSTRACT

Provided is a method of forming a hot press product, the method including: a positioning and placing step of positioning a material, which is heated, and placing the material on a mold through engagement between a positioning pin provided to the mold and a positioning hole provided in the material; and a pressing and hole expanding step of performing press forming on the material through use of the mold, and expanding the positioning hole through bulging of a peripheral part of the positioning hole of the material) when the press forming is performed.

3 Claims, 15 Drawing Sheets

R1
R2
R3
d1
d2
d3
1
3
5
7

HOT PRESS PRODUCT AND METHOD OF FORMING THE SAME

CROSS-REFERENCE TO RELATED APPLICATIONS

The present application claims priority from Japanese Patent Application No. 2012-120505 filed on May 28, 2012 and Japanese Patent Application No. 2013-25162 filed on Feb. 13, 2013, the contents of both of which are hereby incorporated by reference into this application.

BACKGROUND

1. Field

This disclosure relates to a hot press product and a method of forming the hot press product. In particular, this disclosure relates to a method of forming a hot press product by hot-pressing a material as a blank of the hot press product through use of a mold with the material being positioned with respect to the mold through engagement between a positioning pin provided to the mold and a positioning hole provided in the material, and to a hot press product to be formed by using the method.

2. Description of the Related Art

In hot pressing according to the related art, as illustrated in FIG. 16A, a plate-like material 303 having a positioning hole 301 formed therein is heated, and the heated material 303 is positioned and placed on a mold 307 having a positioning pin 305. The positioning is performed by causing the positioning pin 305 of a lower die 307A to pass through the positioning hole 301 of the material 303.

Subsequently, as illustrated in FIG. 16B and FIG. 16C, an upper die 307B is lowered, and the material 303 is pressed by sandwiching the material 303 between the lower die 307A and the upper die 307B. In this manner, the hot pressing is performed to form the material.

Subsequently, as illustrated in FIG. 16C, the material 303 undergoes forced cooling while maintaining a state in which the upper die 307B is located at a bottom dead center. In this manner, quenching is performed on the material 303.

After that, the upper die 307B is separated from the lower die 307A, and a hot press product 311 formed from the material 303 is taken out of the mold 307.

Under the state in which the upper die 307B is located at the bottom dead center, the upper die 307B is proximate to the lower die 307A, and the material 303 sandwiched between the lower die 307A and the upper die 307B is shaped into the hot press product 311.

The above-mentioned related art is disclosed in, for example, Japanese Patent Application Laid-open No. 2008-221284.

SUMMARY

According to an exemplary embodiment of this disclosure, there is provided a method of forming a hot press product, the method including: a positioning and placing step of positioning a material, which is heated, and placing the material on a mold through engagement between a positioning pin provided to the mold and a positioning hole provided in the material; and a pressing and hole expanding step of performing press forming on the material through use of the mold after the material is positioned and placed on the mold in the positioning and placing step, and expanding the positioning hole through bulging of a peripheral part of the positioning hole of the material when the press forming is performed.

According to another exemplary embodiment of this disclosure, there is provided a hot press product, including a bulging portion formed around a positioning hole, in which an inner diameter of the positioning hole, which shrinks when a temperature of the hot press product returns to room temperature, is increased by the bulging portion.

DETAILED DESCRIPTION

This disclosure provides a hot press product and a method of forming the hot press product by heating a material having a positioning hole formed therein, positioning and placing the heated material on a mold through engagement between a positioning pin of the mold and the positioning hole of the material, forming the material through use of the mold, and quenching the material. The hot press product and the method of forming the hot press product are capable of preventing deformation of the positioning hole and its peripheral part that is caused in a case where the positioning hole is snagged on the positioning pin when taking the formed and quenched material (hot press product) out of the mold.

A hot press product (hot press forming product) 1 according to an embodiment of this disclosure is used for a vehicle as in bumper reinforcement for a vehicle, an impact protection beam for a vehicle door, and center pillar reinforcement. The hot press product 1 is not limited to those applications, and is also used for other objects than a vehicle.

Figure 1:
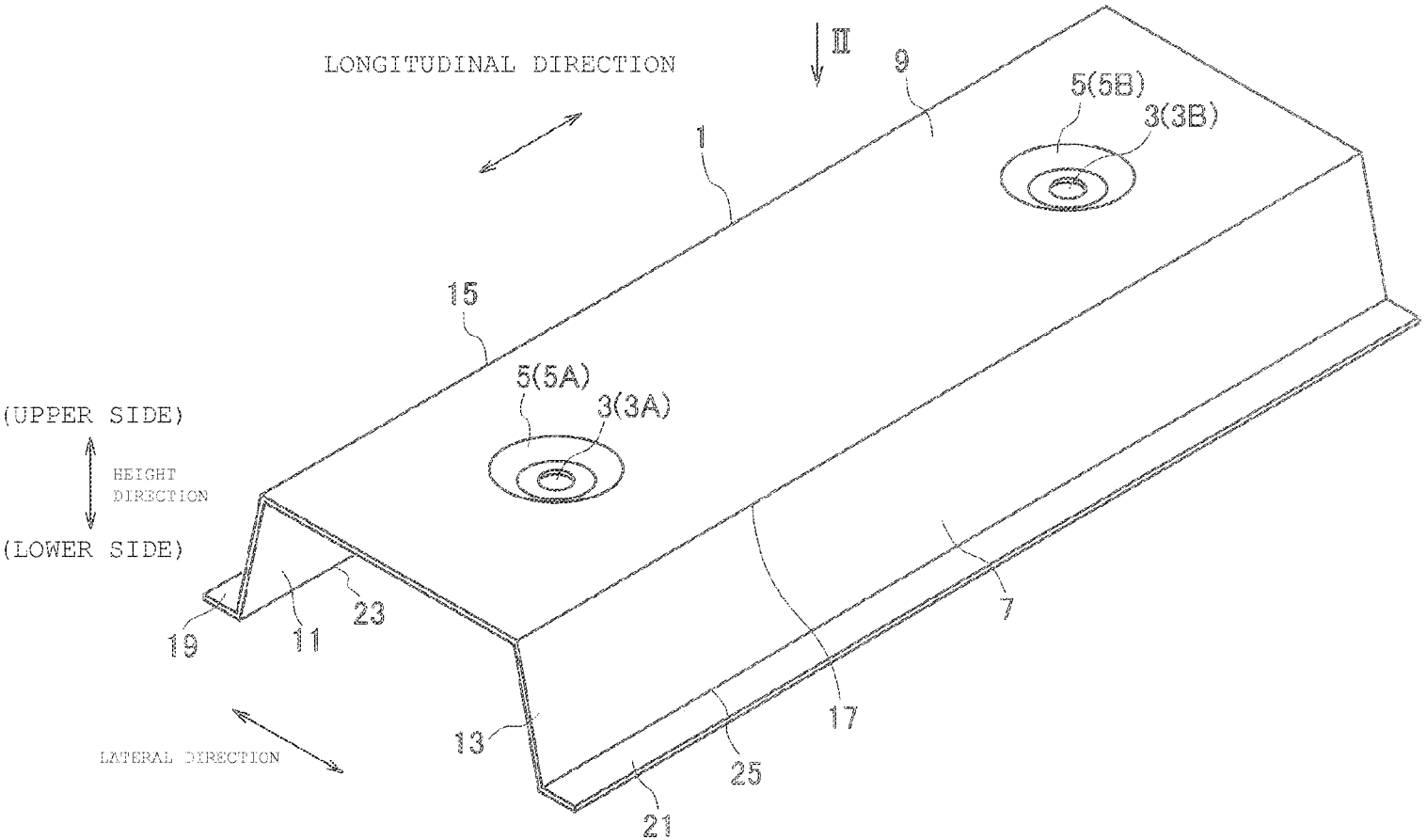
FIG. 1 is a perspective view of a hot press product according to an embodiment of this disclosure.
Figure 2A:
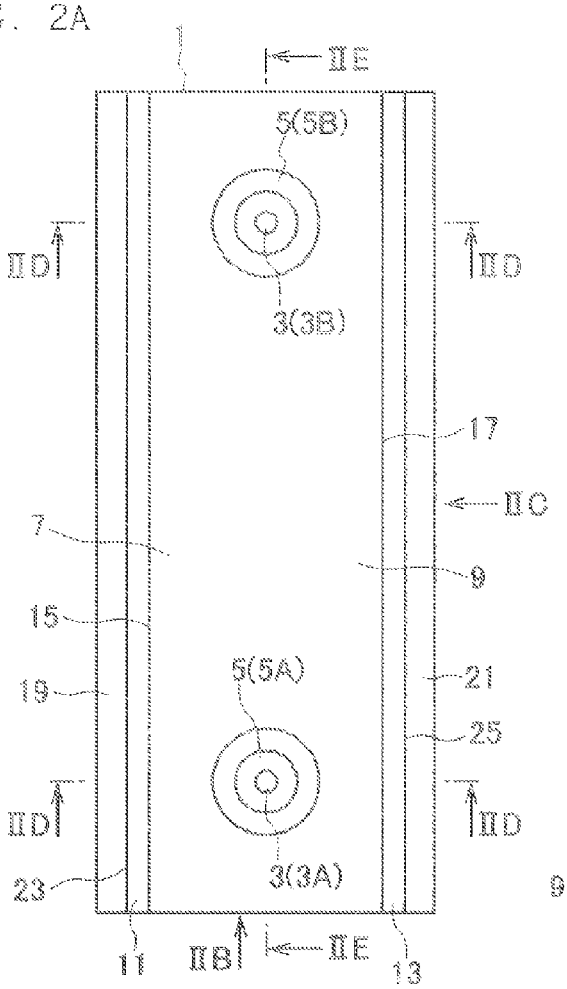
FIG. 2A is a view taken in the arrow II direction of FIG. 1.
Figure 2C:
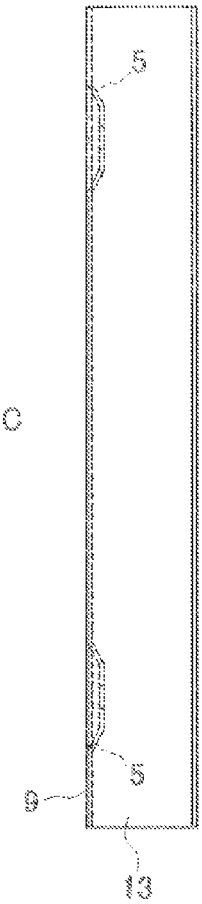
FIG. 2C is a view taken in the arrow IIC direction of FIG. 2A.

The hot press product 1 is manufactured by hot-pressing, for example, a metal material having a flat plate shape (steel plate having a high tensile force or the like). As illustrated in FIG. 1 and FIG. 2A, for example, the hot press product 1 includes bulging portions (depressed portions) 5 (5A and 5B) respectively around positioning holes 3 (3A and 3B) formed into a circular or other suitable shape.

Further, in the hot press product 1, the inner diameter of each positioning hole 3, which shrinks when the temperature of the hot press product 1 returns to room temperature, is increased by the corresponding bulging portion 5. Further, reduction in pitch of the positioning holes 3 is prevented by the respective bulging portions 5.

Figures 3A, 3B, 3C:
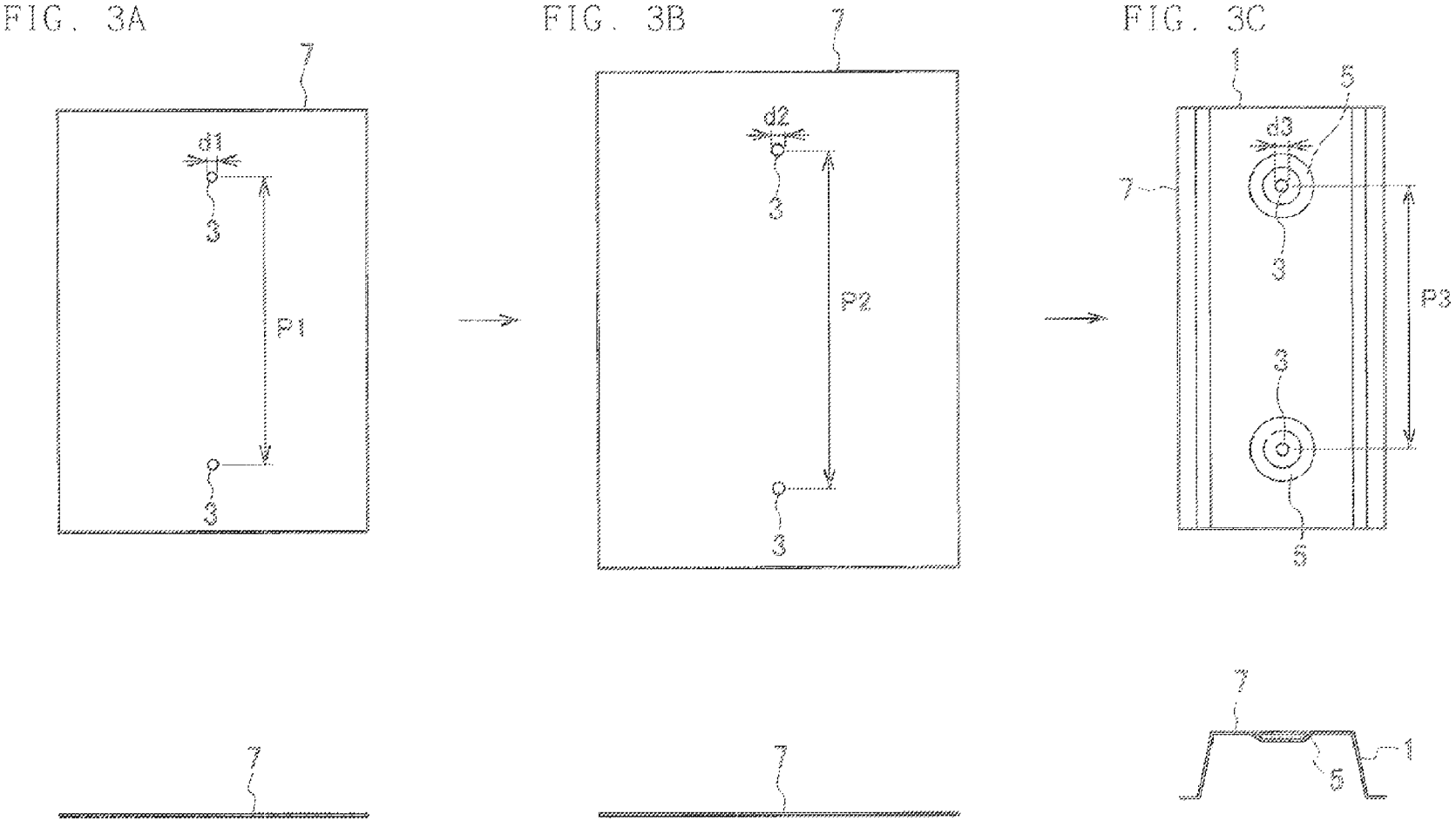
FIG. 3A, FIG. 3B, and FIG. 3C are views illustrating a change in inner diameter of positioning holes and the like at the time of forming the hot press product according to the embodiment of this disclosure from a plate-like material.

Detailed description is given with reference to FIG. 3A to FIG. 3C. FIG. 3A illustrates a material 7 at room temperature. FIG. 3B illustrates the material 7 heated up to a transformation temperature of $Ac_3$ or more (for example, approximately 900° C.). FIG. 3C illustrates the hot press product 1 at room temperature.

An inner diameter d2 of the positioning hole 3 illustrated in FIG. 3B is larger than an inner diameter d1 of the positioning hole 3 illustrated in FIG. 3A due to the temperature rise of the material 7. On the other hand, assuming that the bulging portions 5 are not formed, an inner diameter d3 of the positioning hole 3 illustrated in FIG. 3C would be smaller than the inner diameter d2 of the positioning hole 3 illustrated in FIG. 3B and substantially equal to the inner diameter d1 of the positioning hole 3 illustrated in FIG. 3A because the positioning hole 3 shrinks as the hot press product 1 returns to room temperature.

However, as illustrated in FIG. 3C, the bulging portions 5 are formed around the respective positioning holes 3, and hence the inner diameter d3 of the positioning hole 3 illustrated in FIG. 3C is larger than the inner diameter d1 of the positioning hole 3 illustrated in FIG. 3A. That is, the inner diameter of the positioning hole 3 is increased.

Note that a pitch P2 of the pair of positioning holes 3 illustrated in FIG. 3B is larger than a pitch P1 of the pair of positioning holes 3 illustrated in FIG. 3A, and a pitch P3 of the pair of positioning holes 3 illustrated in FIG. 3C is larger than the pitch P1 of the pair of positioning holes 3 illustrated in FIG. 3A and smaller than the pitch P2 of the pair of positioning holes 3 illustrated in FIG. 3B because the reduction in pitch of the positioning holes 3 is prevented by the respective bulging portions 5.

The hot press product 1 is described in more detail by way of examples.

For convenience of the description, one direction of the hot press product 1, a mold 27, or the like is defined as a longitudinal direction, and another direction orthogonal to the longitudinal direction is defined as a lateral direction. Further, a direction orthogonal to the longitudinal direction and the lateral direction is defined as a height direction.

Figure 2E:
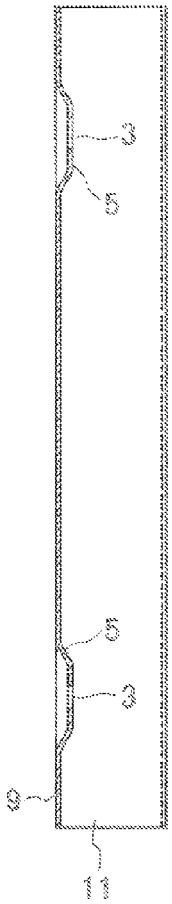
FIG. 2E is a sectional view taken along the line IIE-IIE of FIG. 2A.

As illustrated in FIG. 1 to FIG. 2E, the hot press product 1 includes a top plate section 9, a first side plate section 11, and a second side plate section 13.

The rectangular first side plate section 11 projects from one end portion 15 of the rectangular top plate section 9 in the lateral direction toward one side (lower side) of the top plate section 9 in a thickness direction thereof.

The rectangular second side plate section 13 projects from another end portion 17 of the rectangular top plate section 9 in the lateral direction toward the one side (lower side; the same side as in the case of the first side plate section 11) of the top plate section 9 in the thickness direction thereof.

Further, in some embodiments, the hot press product 1 includes a pair of rectangular flange sections 19 and 21 in addition to the top plate section 9 and the pair of first and second side plate sections 11 and 13. The flange sections 19 and 21 project in the lateral direction from end portions 23 and 25 of the first and second side plate sections 11 and 13, respectively.

Figure 2B:
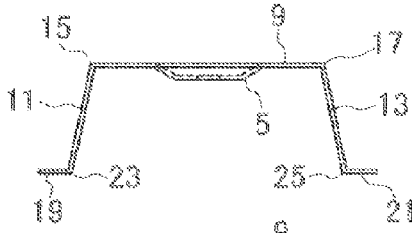
FIG. 2B is a view taken in the arrow IIB direction of FIG. 2A.
Figure 2D:
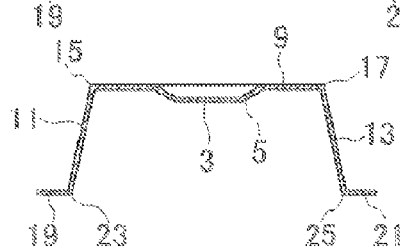
FIG. 2D is a sectional view taken along the line IID-IID of FIG. 2A.

Specifically, when the hot press product 1 including the top plate section 9, the pair of first and second side plate sections 11 and 13, and the pair of flange sections 19 and 21 is seen in the longitudinal direction thereof, the hot press product 1 is formed into a "hat" shape (see FIG. 2B and FIG. 2D).

Further, when the hot press product 1 is seen in the longitudinal direction thereof, the top plate section 9 extends in the lateral direction. Further, the first side plate section 11 of the pair of side plate sections extends in the height direction (toward the lower side) from the one end portion 15 of the top plate section 9 in the lateral direction, and the second side plate section 13 of the pair of side plate sections extends in the height direction (toward the same lower side as in the case of the first side plate section 11) from the another end portion 17 of the top plate section 9 in the lateral direction.

Note that the pair of first and second side plate sections 11 and 13 is not completely orthogonal to the top plate section 9 in some embodiments, and the intersection angle between the top plate section 9 and each of the first and second side plate sections 11 and 13 is an obtuse angle in some embodiments. Thus, the distance between the pair of first and second side plate sections 11 and 13 (distance in the lateral direction)

gradually increases in a direction away from the top plate section 9 (in a downward direction).

Further, when the hot press product 1 is seen in the longitudinal direction thereof, the one flange section 19 of the pair of flange sections extends from the end portion 23 (lower end portion located opposite to the top plate section 9) of the first side plate section 11 in the lateral direction away from the top plate section 9 (in a direction away from the second side plate section 13), and the another flange section 21 of the pair of flange sections extends from the end portion 25 (lower end portion located opposite to the top plate section 9) of the second side plate section 13 in the lateral direction away from the top plate section 9 (in a direction away from the first side plate section 11). Further, the thickness direction of each of the top plate section 9 and the flange sections 19 and 21 corresponds to the height direction.

In one embodiment, a plurality of positioning holes 3 (3A and 3B) are provided (two positioning holes 3 are provided in FIG. 1, FIG. 2A, FIG. 2C, and FIG. 2E). Similarly, in some embodiments, a plurality of bulging portions 5 (5A and 5B) are provided (two bulging portions 5 are provided in FIG. 1, FIG. 2A, FIG. 2C, and FIG. 2E) corresponding to the number of positioning holes 3. The part of the top plate section 9 in which the bulging portions 5 are formed is depressed downward. Further, the bulging portions 5 are formed as depressed portions having a circular truncated cone shape, and are gradually reduced in diameter toward the lower side.

The one bulging portion 5A is arranged at the center of the top plate section 9 in the lateral direction away from the end portions 15 and 17 of the top plate section 9, and is arranged on one end side in the longitudinal direction. The another bulging portion 5B is also arranged at the center of the top plate section 9 in the lateral direction away from the end portions 15 and 17 of the top plate section 9, and is arranged on another end side in the longitudinal direction.

Each positioning hole 3 is provided at the center of the corresponding bulging portion 5, and passes through a bottom portion of the bulging portion 5 in the thickness direction thereof. Further, the inner diameter of the positioning hole 3 is smaller than the diameter of the bottom portion of the bulging portion 5.

Figure 4A:
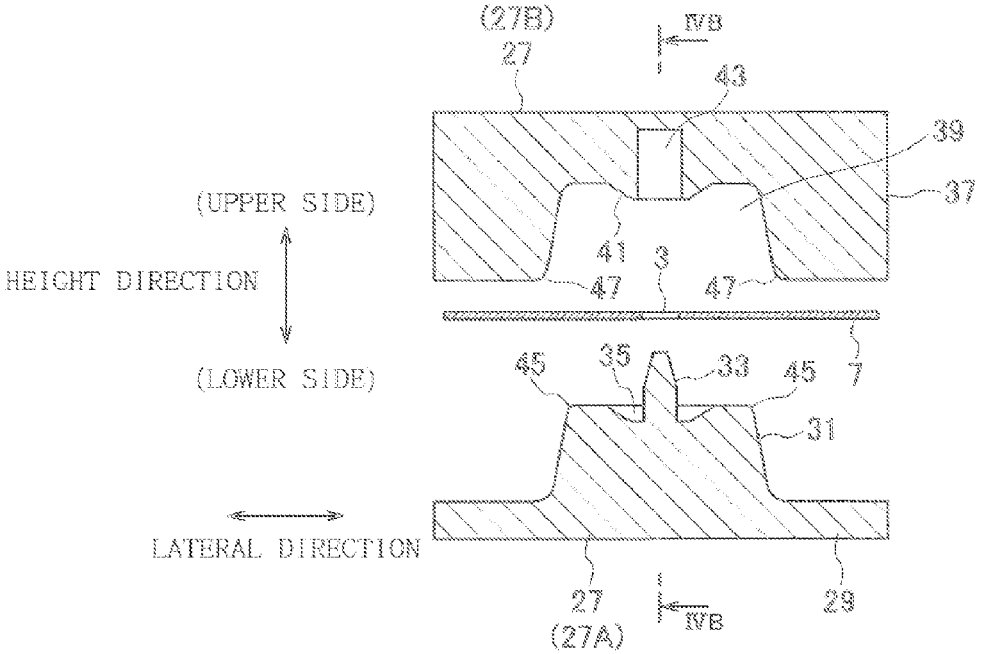
FIG. 4A is a view illustrating a method of forming the hot press product according to the embodiment of this disclosure through use of a mold.
Figure 4B:
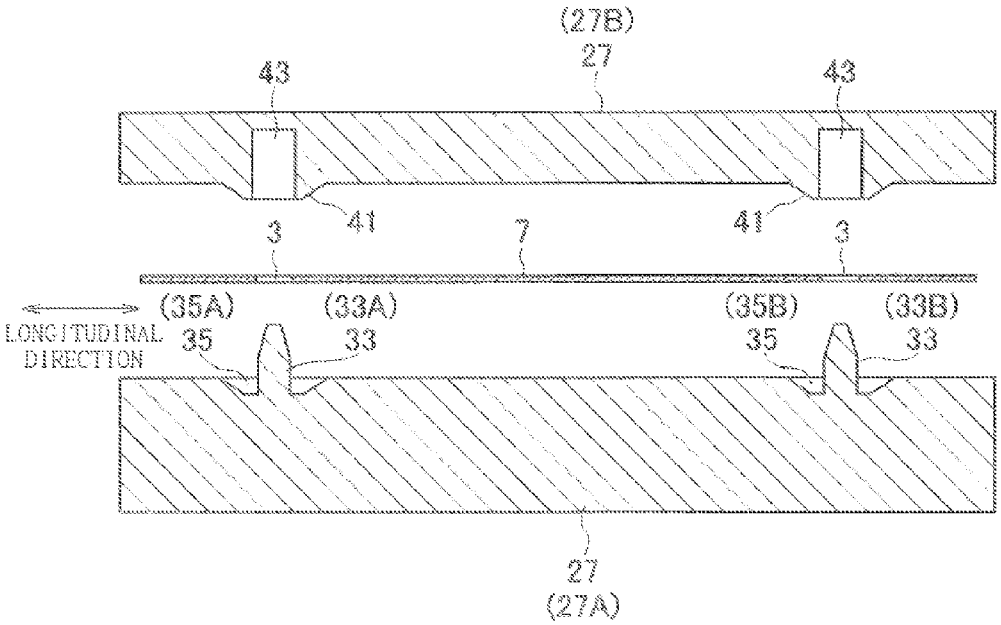
FIG. 4B is a sectional view taken along the line IVB-IVB of FIG. 4A.

As illustrated in FIG. 4A, FIG. 4B, and other figures, the mold 27 to be used for press forming of the hot press product 1 includes, for example, a lower die 27A and an upper die 27B.

The lower die 27A includes a main body section 29 and a projecting section 31. The main body section 29 is formed into, for example, a rectangular plate shape. The projecting section 31 is formed into, for example, a shape of an isosceles trapezoid solid.

The projecting section 31 projects upward at the center portion of the main body section 29 in the lateral direction, and is provided over the entire length of the main body section 29 in the longitudinal direction. The direction of the height of the isosceles trapezoid solid in the projecting section 31 corresponds to the longitudinal direction of the main body section 29. Further, the dimension of the projecting section 31 in the lateral direction gradually decreases in a direction away from the main body section 29 (in an upward direction).

Depressed portions 35 (35A and 35B) having a circular truncated cone shape are formed in a planar top surface of the projecting section 31. The depressed portions 35 are located at the center portions of the projecting section 31 in the lateral direction, and located at one end portion side and another end portion side of the projecting section 31 in the longitudinal direction. The diameter of each depressed portion 35 is smaller than the dimension of the top surface of the projecting section 31 in a width direction thereof.

Positioning pins 33 (33A and 33B) of the mold 27 are provided integrally to the lower die 27A. That is, the positioning pins 33 are fixed. The positioning pins 33 may be provided separately and fixed with bolts or the like. Each positioning pin 33 is formed into, for example, a columnar shape having a tapered distal end portion, and projects upward from a bottom surface of the corresponding depressed portion 35 of the projecting section 31 at the center of the projecting section 31. The outer diameter of the positioning pin 33 is smaller than the diameter of the bottom surface of the depressed portion 35.

Accordingly, the peripheral part of each positioning pin 33 (annular peripheral part) is depressed downward with respect to the planar top surface of the projecting section 31. The positioning pin 33 projects upward in the height direction with respect to the planar top surface of the projecting section 31.

The upper die 27B includes a main body section 37 formed into, for example, a rectangular solid shape. A depressed section 39 is formed in the main body section 37, and projecting portions 41 (41A and 41B) that project downward from a bottom surface of the depressed section 39 are formed in the depressed section 39. A depressed portion 43 is formed in each projecting portion 41.

Figure 8A:
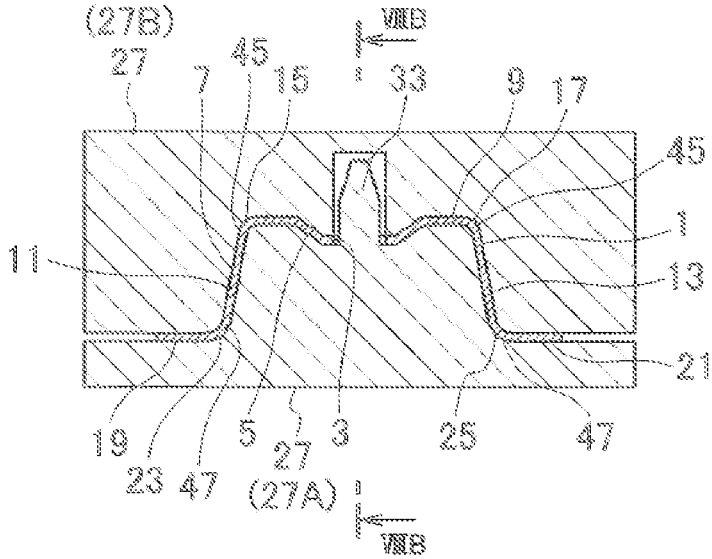
FIG. 8A is a view illustrating the method of forming the hot press product according to the embodiment of this disclosure through use of the mold.
Figure 8B:
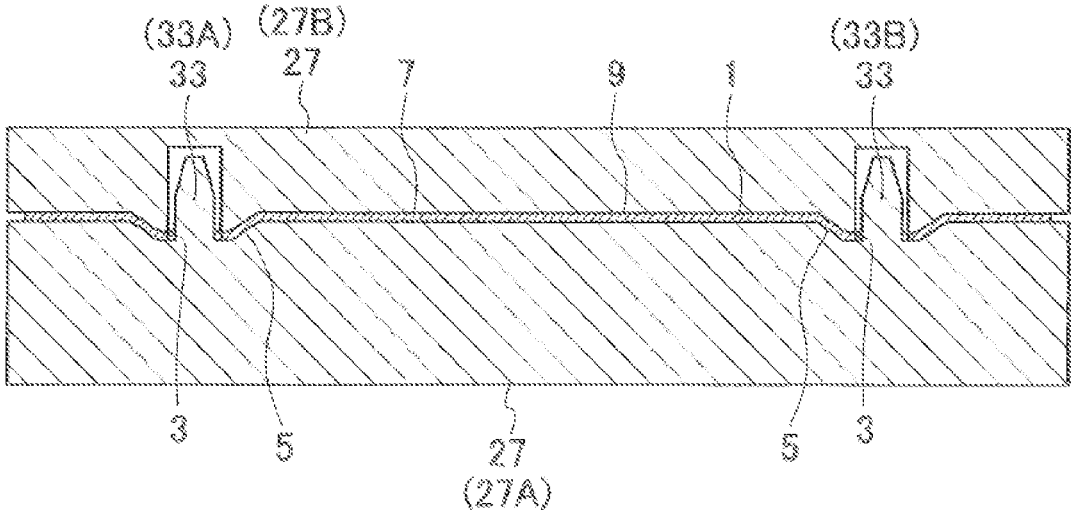
FIG. 8B is a sectional view taken along the line VIIIB-VIIIB of FIG. 8A.
Figure 9A:
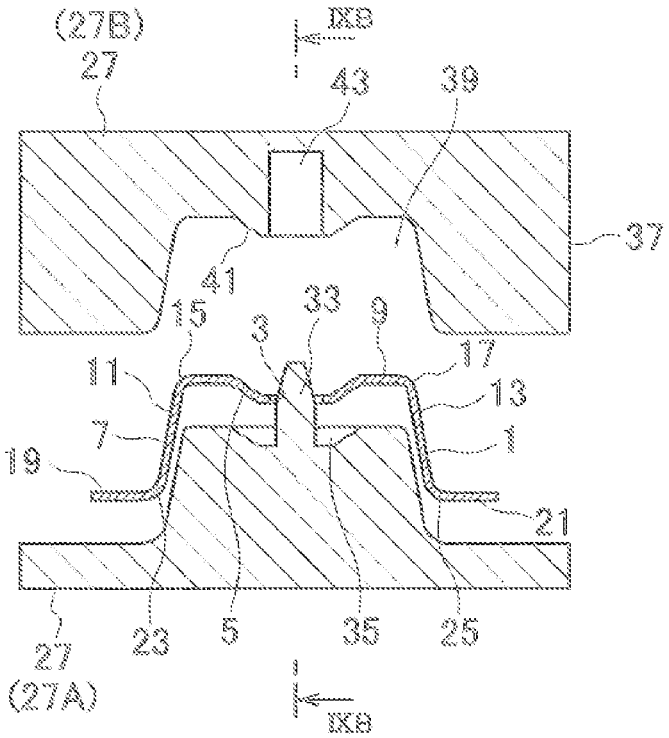
FIG. 9A is a view illustrating the method of forming the hot press product according to the embodiment of this disclosure through use of the mold.
Figure 9B:
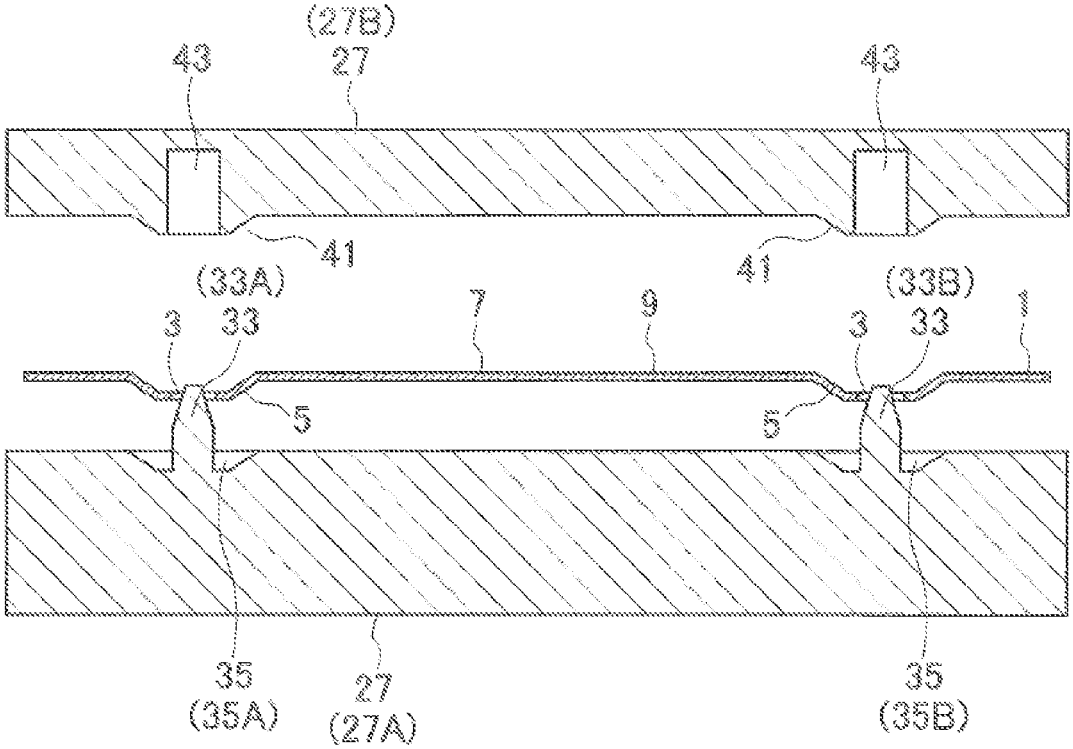
FIG. 9B is a sectional view taken along the line IXB-IXB of FIG. 9A.

When the upper die 27B is located at a bottom dead center, as illustrated in FIG. 8A and FIG. 8B, the projecting section 31 of the lower die 27A enters the depressed section 39 of the upper die 27B. In this case, the projecting portions 41 of the upper die 27B enter the respective depressed portions 35 of the lower die 27A, and the positioning pins 33 of the lower die 27A enter the respective depressed portions 43 of the upper die 27B. As a result, a clearance having a size of approximately a thickness of the material 7 is formed between the upper die 27B and the lower die 27A.

Note that, in order to perform hot quenching and the like on the material 7, the mold 27 is sometimes provided with a heater for heating the material 7 and a cooling portion (water channel or the like) for cooling the material 7.

Next, description is given of a method of forming the hot press product 1 through use of the mold 27 that is taken as an example of the device for forming the material 7.

Figure 5A:
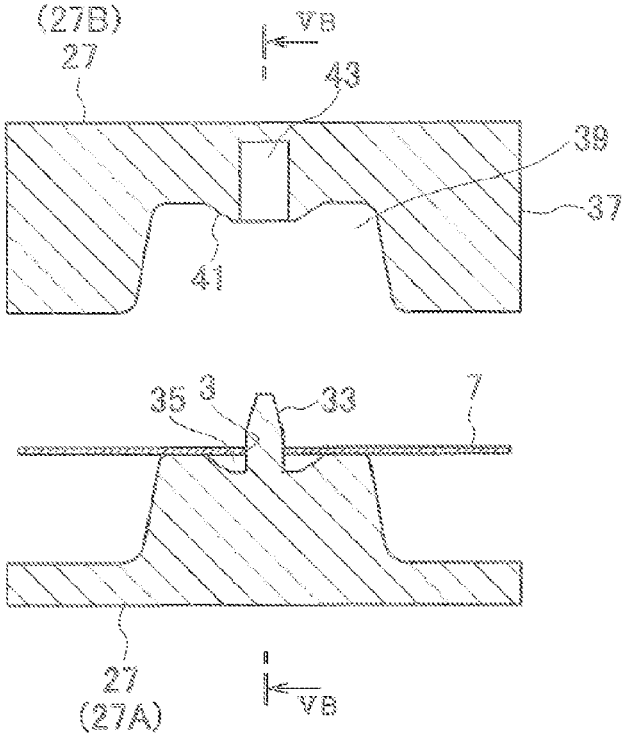
FIG. 5A is a view illustrating the method of forming the hot press product according to the embodiment of this disclosure through use of the mold.
Figure 5B:
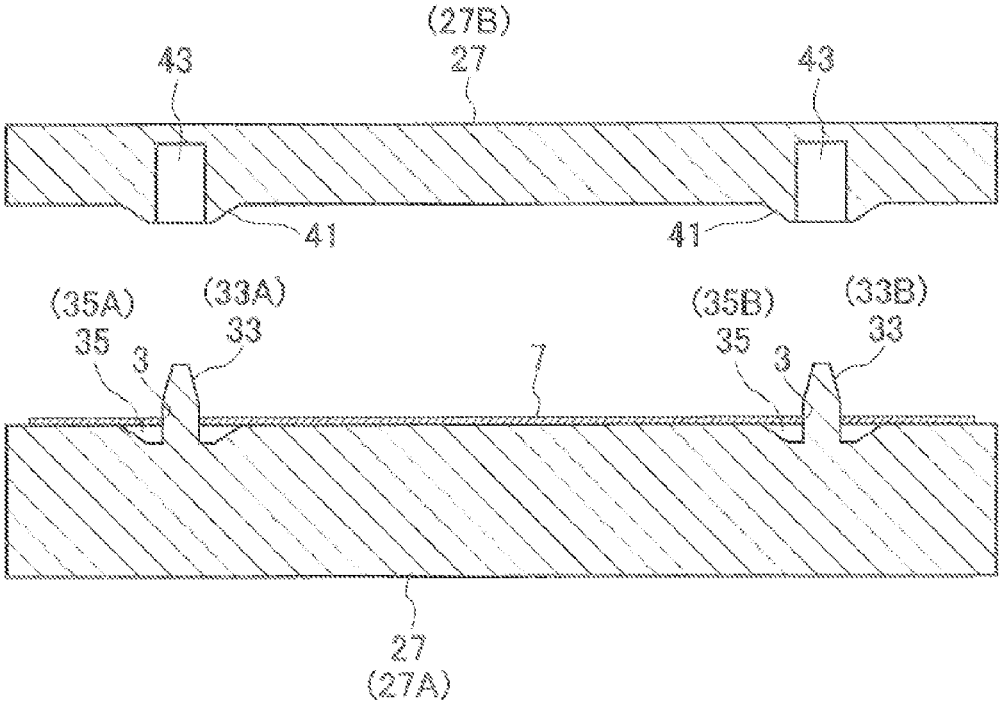
FIG. 5B is a sectional view taken along the line VB-VB of FIG. 5A.
Figure 6:
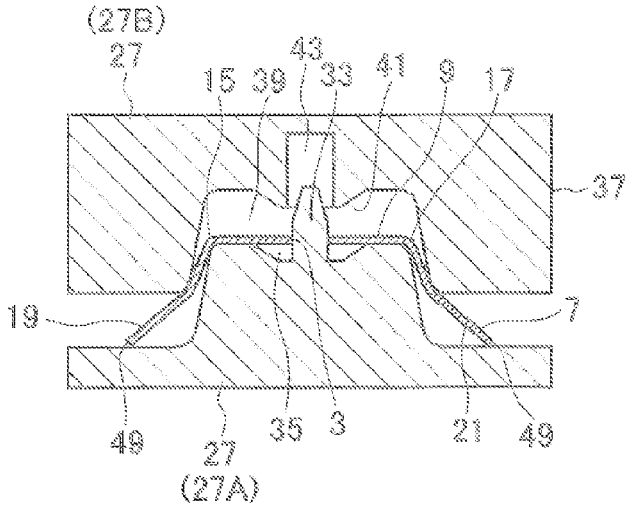
FIG. 6 is a view illustrating the method of forming the hot press product according to the embodiment of this disclosure through use of the mold.

First, as illustrated in FIG. 4A and FIG. 4B, under a state in which the upper die 27B is raised and separated from the lower die 27A, the positioning pins 33 provided to the mold 27 are engaged with the respective positioning holes 3 (holes having a diameter equal to or slightly larger than the diameter of the positioning pins 33) provided in the plate-like material 7 that is heated for hot pressing (the positioning pins 33 are caused to pass through the positioning holes 3 of the material 7), to thereby position the material 7 and place the material 7 on the mold 27 (lower die 27A) (see FIG. 5A and FIG. 5B; positioning and placing step).

Specifically, the inner diameter of each positioning hole 3 of the heated material 7 is substantially equal to the outer diameter of the corresponding positioning pin 33 of the mold 27, and the pitch of the positioning holes 3A and 3B is substantially equal to the pitch of the respective positioning pins 33A and 33B. Accordingly, a backlash of the material 7 with respect to the mold 27 is substantially eliminated.

After the material 7 is positioned and placed on the mold 27 in the positioning and placing step, the material 7 is subjected to press forming through use of the mold 27 (the upper die 27B is brought relatively close to the lower die 27A and the material 7 is pressed by sandwiching the material 7 between the upper die 27B and the lower die 27A). Further, when performing the press forming, the peripheral parts of the positioning holes 3 of the material 7 are bulged to expand the positioning holes 3 (see FIG. 6 to FIG. 8B; pressing and hole expanding step).

In the pressing and hole expanding step, the temperature of the material 7 exceeds approximately 500° C. for subsequent quenching, and the material 7 is subjected to hot pressing.

The expansion of the positioning holes 3 through bulging of the peripheral parts of the positioning holes 3 is performed so as to prevent the positioning holes 3 from clinging to the respective positioning pins 33 due to shrinkage of the cooled material 7 and therefore preventing the material 7 from being removed or removed without difficulty from the positioning pins 33. Through the expansion of the positioning holes 3, for example, the inner diameter of each positioning hole 3 becomes larger than the outer diameter of the corresponding positioning pin 33.

After the material 7 is subjected to the press forming and the peripheral parts of the positioning holes 3 are bulged (after the bulging portions 5 are formed) in the pressing and hole expanding step, the material 7 is cooled while maintaining the state in which the material 7 is pressed by the mold 27, to thereby perform quenching on the material 7 (quenching step). At this time, the reduction in pitch of the positioning holes 3 is prevented by the respective bulging portions 5. Further, the bulging portions 5 also function to position the material 7 after the expansion of the positioning holes 3.

Note that, under the state in which the material 7 is pressed by the mold 27, similarly to the related art, for example, the upper die 27B is located at the bottom dead center. In this case, the upper die 27B is proximate to the lower die 27A, and the material 7 sandwiched between the lower die 27A and the upper die 27B is shaped into the hot press product 1. Further, the positioning holes 3 are held in a state of securing a clearance between the positioning holes 3 and the respective positioning pins 33 even when the inner diameter of each positioning hole 3 and the pitch of the positioning holes 3A and 3B are reduced because the quenching is performed so that the temperature of the material 7 (hot press product 1) becomes room temperature.

After the quenching is performed on the material 7 in the quenching step, the upper die 27B is separated relatively from the lower die 27A so that the material 7 is no longer sandwiched by the mold 27, and the formed material 7 is released from the mold 27. The released material 7 is taken out of the mold 27, and accordingly the hot press product 1 is obtained (see FIG. 8A to FIG. 9B).

As described above, the hot press product 1 includes, in addition to the top plate section 9 and the pair of first and second side plate sections 11 and 13, the pair of flange sections 19 and 21 that projects from the end portions 23 and 25 of the pair of first and second side plate sections 11 and 13, respectively.

The pressing and hole expanding step is described in more detail. In the pressing and hole expanding step, when the material 7 is bent at the boundaries between the top plate section 9 and the first side plate section 11 and between the top plate section 9 and the second side plate section 13 to form the first and second side plate sections 11 and 13, and further, the material 7 is bent at the boundaries (end portions 23 and 25) between the first side plate section 11 and the flange section 19 and between the second side plate section 13 and the flange section 21 to form the flange sections 19 and 21 (during the formation of the first and second side plate sections 11 and 13 and the flange sections 19 and 21, that is, when the first and second side plate sections 11 and 13 and the flange sections 19 and 21 are not completely but substantially formed), the first and second side plate sections 11 and 13 and the flange sections 19 and 21 in the process of formation are engaged with the mold 27, to thereby perform holding of the material 7 that is necessary at the time of bulging for forming the bulging portions 5 (see FIG. 6 to FIG. 7B).

In further detail, during the press forming of the material 7, the upper die 27B is lowered, and the upper die 27B is brought close to the lower die 27A. Accordingly, the material 7 is bent, and the formation of the pair of first and second side plate sections 11 and 13 and the pair of flange sections 19 and 21 is first started (see FIG. 6). That is, the material 7 starts to be bent at the boundaries (end portions 15 and 17) between the top plate section 9 and the first side plate section 11 and between the top plate section 9 and the second side plate section 13, and at the boundaries (end portions 23 and 25) between the first side plate section 11 and the flange section 19 and between the second side plate section 13 and the flange section 21.

Figure 7A:
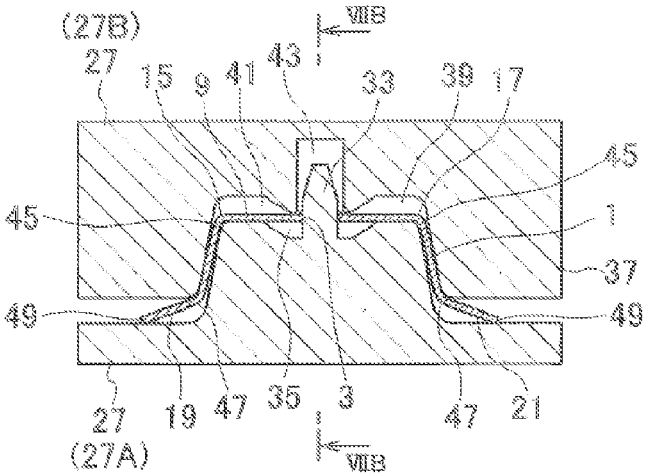
FIG. 7A is a view illustrating the method of forming the hot press product according to the embodiment of this disclosure through use of the mold.
Figure 7B:
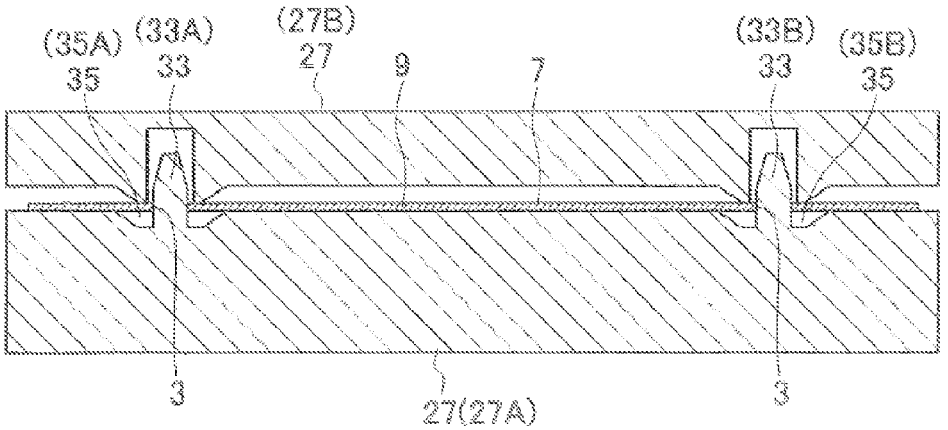
FIG. 7B is a sectional view taken along the line VIIB-VIIB of FIG. 7A.

When the upper die 27B is brought further close to the lower die 27A, the top plate section 9, the pair of first and second side plate sections 11 and 13, and the pair of flange sections 19 and 21 are substantially formed so that the material 7 is formed into a substantially "hat" shape (see FIG. 7A). At this time, the top plate section 9 (for example, the peripheral parts of the positioning holes 3) is not sandwiched between the upper die 27B and the lower die 27A, and thus the bulging is not performed.

When the upper die 27B is brought further close to the lower die 27A, the peripheral parts of the positioning holes 3 start to be bulged by the upper die 27B and the lower die 27A (see FIG. 7A to FIG. 8B).

When the bulging is performed, the pair of boundaries (end portions 15 and 17, that is, bending portions) between the top plate section 9 and the first side plate section 11 and between the top plate section 9 and the second side plate section 13 abuts against edges 45 of the lower die 27A, respectively, so that the pair of first and second side plate sections 11 and 13 sandwiches the projecting section 31 of the lower die 27A. Further, the pair of boundaries (end portions 23 and 25, that is, bending portions) between the first side plate section 11 and the flange section 19 and between the second side plate section 13 and the flange section 21 abuts against edges 47 of the upper die 27B, respectively, and distal end portions 49 (end portions located opposite to the first and second side plate sections 11 and 13) of the flange sections 19 and 21 abut against the main body section 29 of the lower die 27A. Then, the first and second side plate sections 11 and 13 and the flange sections 19 and 21 are sandwiched between the lower die 27A and the upper die 27B so that the material 7 is brought into a state of being substantially integrated with the mold 27, to thereby perform the holding of the material 7 that is necessary for the bulging.

Further, along with the bulging, the first and second side plate sections 11 and 13 and the flange sections 19 and 21 are formed by the upper die 27B and the lower die 27A (the material 7 is bent at the boundaries (end portions 15 and 17) between the top plate section 9 and the first side plate section 11 and between the top plate section 9 and the second side plate section 13, and at the boundaries (end portions 23 and 25) between the first side plate section 11 and the flange section 19 and between the second side plate section 13 and the flange section 21).

When the upper die 27B is then brought close to the terminal position relative to the lower die 27A (when the upper die 27B reaches the bottom dead center), the bulging for forming the bulging portions 5 and the formation of the first and second side plate sections 11 and 13 and the flange sections 19 and 21 are completed substantially at the same time. Thus, the formation of the hot press product 1 is finished.

Note that, even in a case where the hot press product 1 does not include the flange sections 19 and 21, the bulging is performed in a similar manner.

Specifically, in the pressing and hole expanding step, when the material 7 is bent at the boundaries (end portions 15 and 17) between the top plate section 9 and the first side plate section 11 and between the top plate section 9 and the second side plate section 13 to form the first and second side plate sections 11 and 13, the first and second side plate sections 11 and 13 in the process of formation are engaged with the mold 27 to thereby perform the holding of the material 7 that is necessary at the time of bulging for forming the bulging portions 5.

According to the hot press product 1, the inner diameter of each positioning hole 3 is increased in the pressing and hole expanding step, and hence, when the hot press product 1 is taken out of the mold 27, the clearance is formed between the positioning holes 3 and the respective positioning pins 33. As a result, it is possible to easily take the hot press product 1 out of the mold 27, and to prevent the deformation of the positioning holes 3 and their peripheral parts that is caused when the positioning holes 3 snag on the respective positioning pins 33 and therefore galling and clinging occur between the positioning holes 3 and the respective positioning pins 33.

Further, according to the hot press product 1, under the state in which the material 7 is positioned and placed on the mold 27, the inner diameter of each positioning hole 3 is substantially equal to the outer diameter of the corresponding positioning pin 33, and the material 7 does not move relative to the mold 27 (the backlash is eliminated). Thus, the positional accuracy of the positioning holes 3 of the hot press product 1 is improved. Further, in the pressing and hole expanding step, the bulging portions 5 also function to position the material 7 after the expansion of the positioning holes 3, and thus the positional accuracy is improved.

Further, according to the hot press product 1, in the pressing and hole expanding step, for example, when the material 7 is bent at the boundaries (end portions 15 and 17) between the top plate section 9 and the first side plate section 11 and between the top plate section 9 and the second side plate section 13 to form the first and second side plate sections 11 and 13, the first and second side plate sections 11 and 13 and the flange sections 19 and 21 in the process of formation are engaged with the mold 27 to thereby perform the holding of the material 7 that is necessary at the time of bulging. Accordingly, with the mold 27 having a simple configuration in which the upper die 27B is moved relative to the lower die 27A, it is possible to reliably obtain a force for restricting the material 7 when increasing the inner diameter of each positioning hole 3 of the material 7 through the bulging.

Further, according to the hot press product 1, the plurality of positioning holes 3 are provided, and the bulging portions 5 are provided around the respective positioning holes 3. Accordingly, it is possible to prevent the reduction in pitch of the positioning holes 3, and to prevent the galling and clinging between the positioning holes 3 and the respective positioning pins 33 that may be caused due to the reduction in pitch of the positioning holes 3. Further, the positioning holes 3 are provided at, for example, both ends of the material 7 so that the pitch of the positioning holes 3 can be increased. Thus, the positional accuracy is improved.

Note that, in the above description, the top plate section 9, the first and second side plate sections 11 and 13, and the flange sections 19 and 21 of the hot press product 1 are formed into a rectangular flat plate shape, but do not need to be formed into such a shape. That is, at least one of the top plate section 9, the first and second side plate sections 11 and 13, and the flange sections 19 and 21 may be formed into a shape of a curved surface having a large curvature radius. In this case, the curvature radius may be constant or variable.

Further, the lengths of projection of the first and second side plate sections 11 and 13 may be different from each other, and the lengths of projection of the flange sections 19 and 21 may be different from each other. Further, the boundaries (end portions 15, 17, 23, and 25; see FIG. 1 and other figures) may have a shape of a curved line instead of the straight line.

Further, a hole other than the positioning holes, a seat (protruding) surface, and the like may be formed in at least one of the top plate section 9, the first and second side plate sections 11 and 13, and the flange sections 19 and 21. The top plate section 9 and the first and second side plate sections 11 and 13 may be formed intermittently in the longitudinal direction without being formed continuously (for example, the top plate section 9 and the first and second side plate sections 11 and 13 may be formed only in a part near the positioning holes 3). The lengths of the first and second side plate sections 11 and 13 and the flange sections 19 and 21 (lengths of projection from the top plate section 9 and the like) may be varied gradually.

Figure 10:
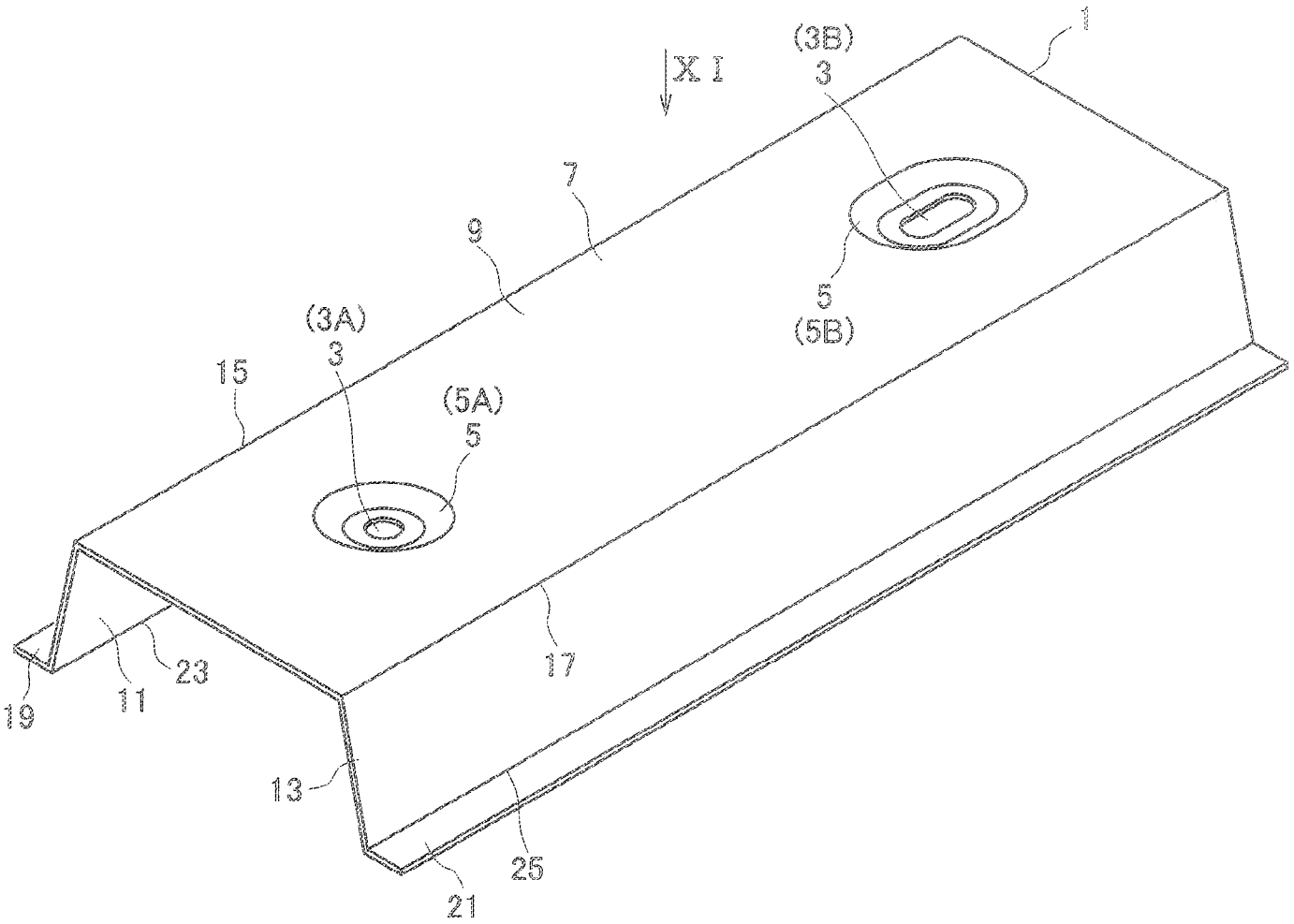
FIG. 10 is a perspective view of a hot press product according to a modification example of this disclosure.
Figure 11A:
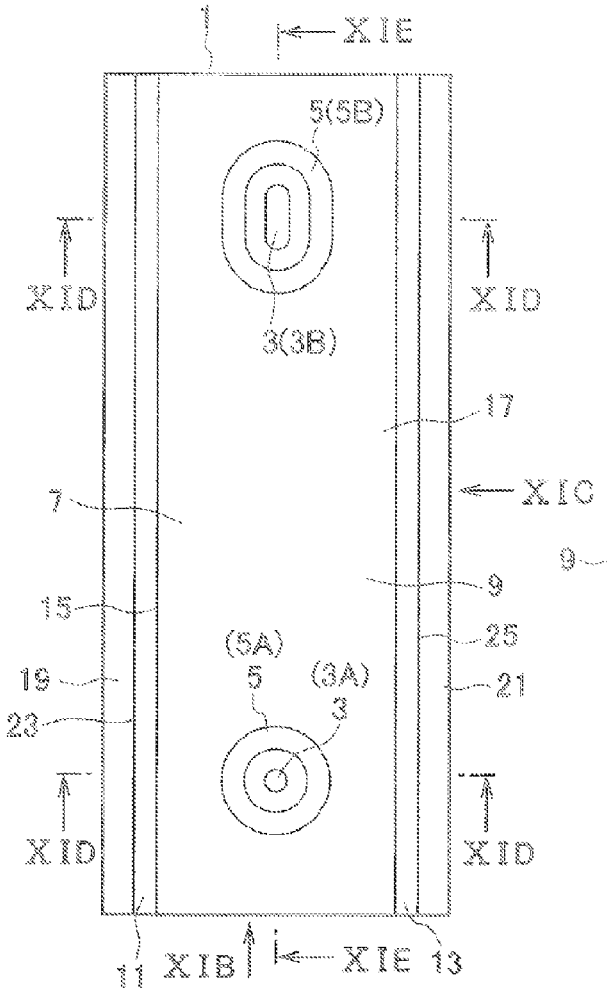
FIG. 11A is a view taken in the arrow XI direction of FIG. 10.
Figure 11C:
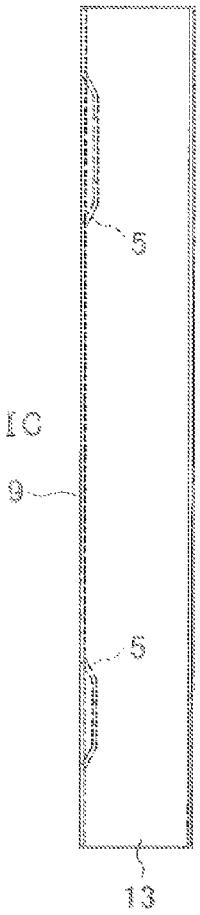
FIG. 11C is a view taken in the arrow XIC direction of FIG. 11A.
Figure 11E:
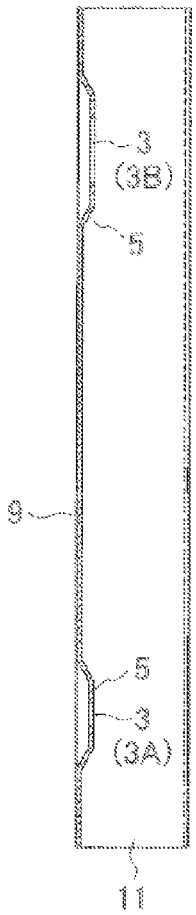
FIG. 11E is a sectional view taken along the line XIE-XIE of FIG. 11A.
Figure 11B:
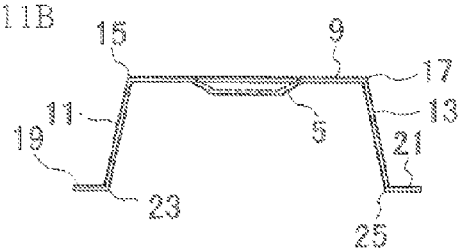
FIG. 11B is a view taken in the arrow XIB direction of FIG. 11A.
Figure 11D:
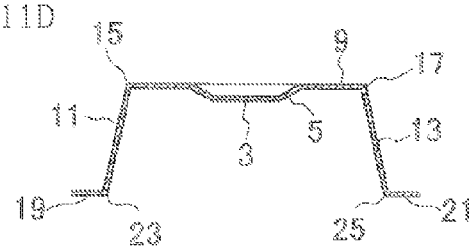
FIG. 11D is a sectional view taken along the line XID-XID of FIG. 11A.

Moreover, in the hot press product 1, as illustrated in FIG. 10 to FIG. 11E, the one positioning hole 3A may be formed into a circular or other suitable shape and the another positioning hole 3B may be formed as an elongated hole (hole having an elliptical or other suitable shape). In this case, the elongated positioning hole 3B is long in a direction connecting the elongated positioning hole 3B to the one positioning hole 3A having a circular shape (for example, in the longitudinal direction), and the bulging portion 5B is also formed into an elliptical shape conforming to the shape of the elongated positioning hole 3B. Note that, the positioning pins 33 of the mold 27 are formed into a columnar shape.

Figure 12A:
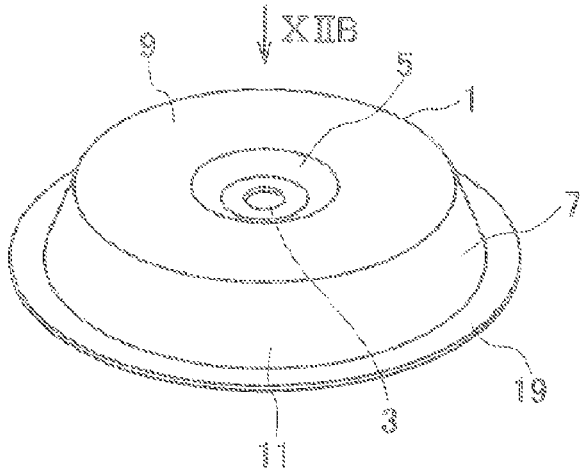
FIG. 12A is a perspective view of a hot press product according to another modification example of this disclosure.
Figure 12B:
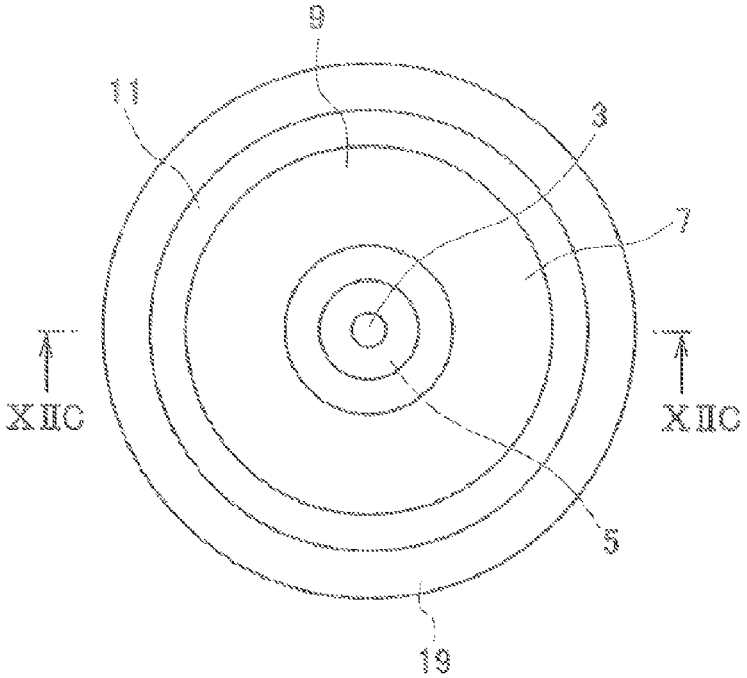
FIG. 12B is a view taken in the arrow XIIB direction of FIG. 12A.
Figure 12C:
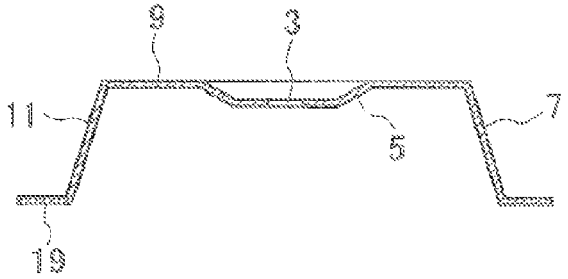
FIG. 12C is a sectional view taken along the line XIIC-XIIC of FIG. 12B.

Further, as illustrated in FIG. 12A to FIG. 12C, the hot press product 1 may be formed into a "hat" shape in cross section, including a top plate section 9 having a circular shape, a side plate section 11 having a shape of a side surface of a circular truncated cone, and an annular flange section 19. In this case, only one positioning hole 3 and one bulging portion 5 are formed at the center of the hot press product 1.

Figure 13A:
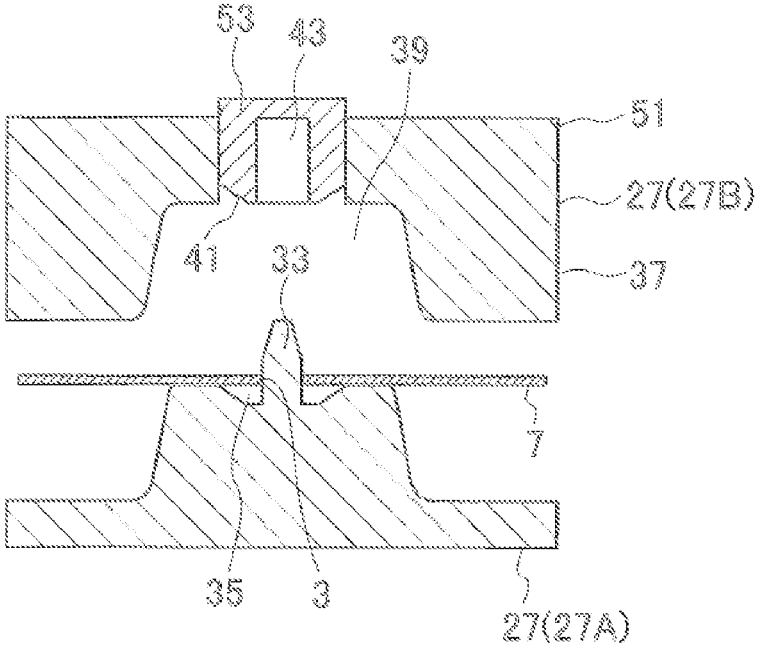
FIG. 13A, FIG. 13B, and FIG. 13C are views illustrating a method of forming a hot press product through use of a mold according to a further modification example of this disclosure.
Figure 13B:
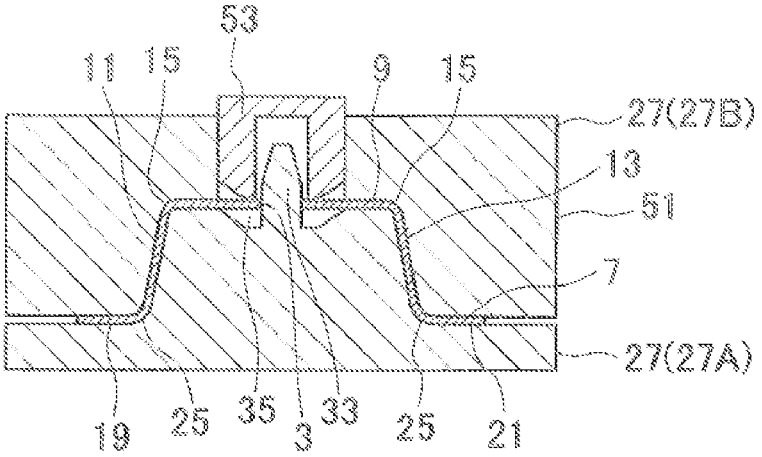
Figure 13C:
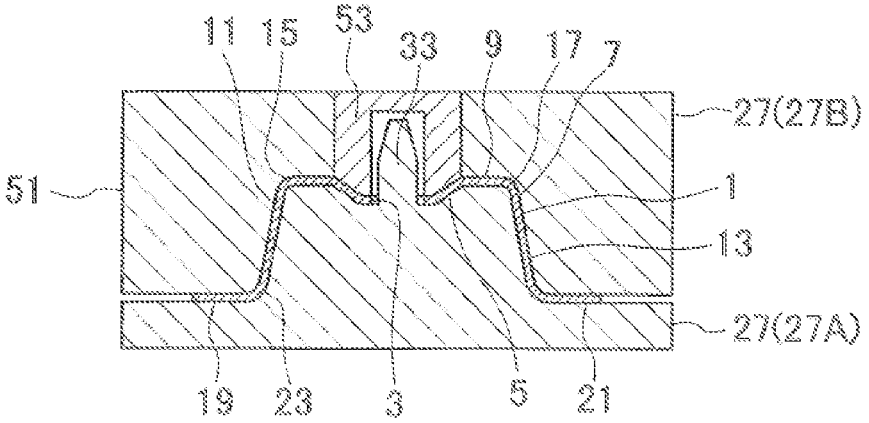
Figure 14A:
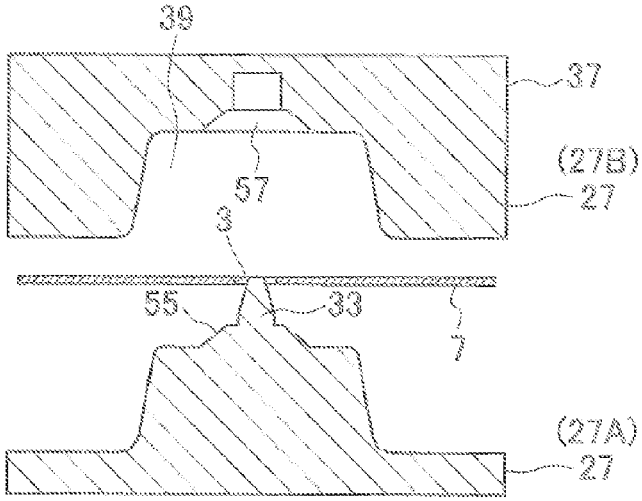
FIG. 14A, FIG. 14B, and FIG. 14C are views illustrating a method of forming a hot press product through use of a mold according to a still further modification example of this disclosure.
Figure 14B:
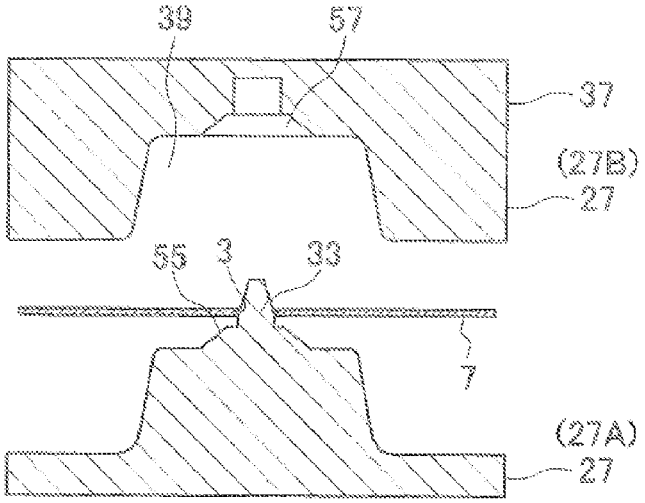
Figure 14C:
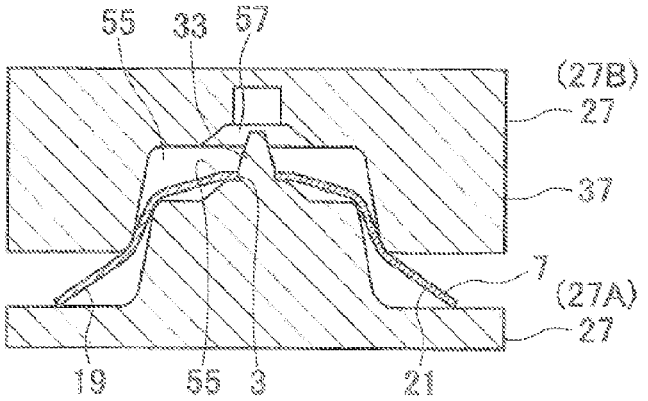
Figure 15A:
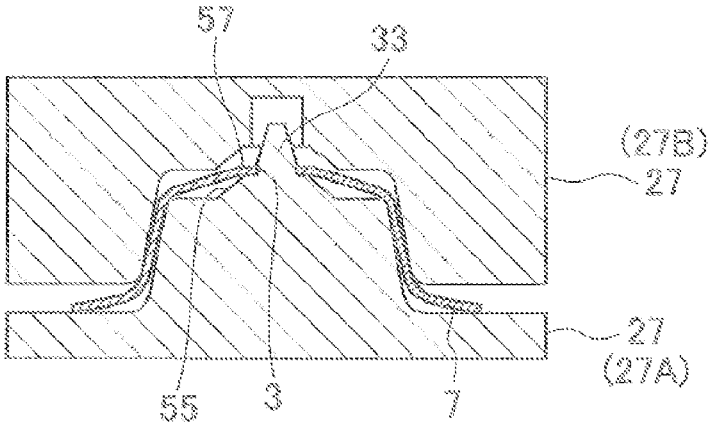
FIG. 15A, FIG. 15B, and FIG. 15C are views illustrating the method of forming a hot press product through use of the mold according to the still further modification example of this disclosure.
Figure 15B:
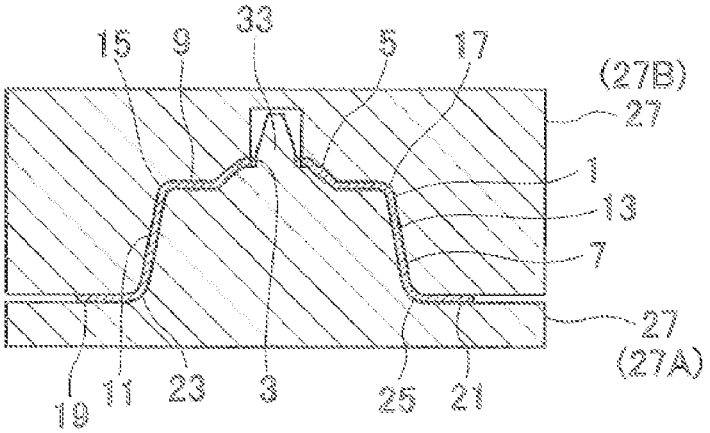
Figure 15C:
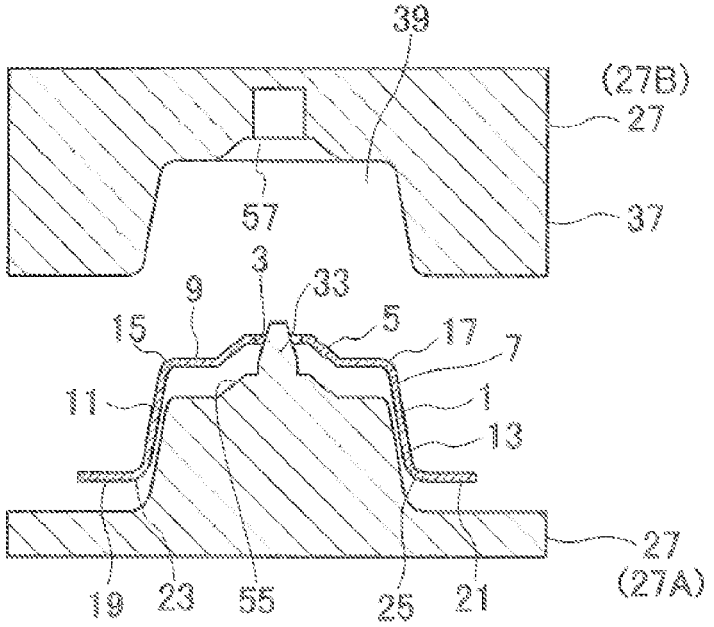
Figure 16A:
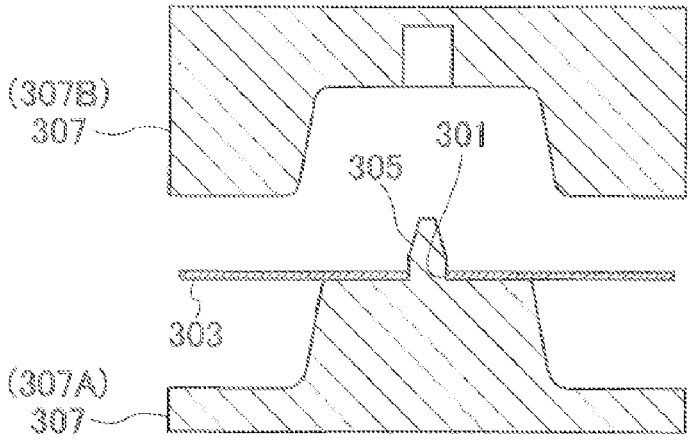
FIG. 16A, FIG. 16B, and FIG. 16C are views illustrating a method of forming a hot press product through use of a mold according to the related art.
Figure 16B:
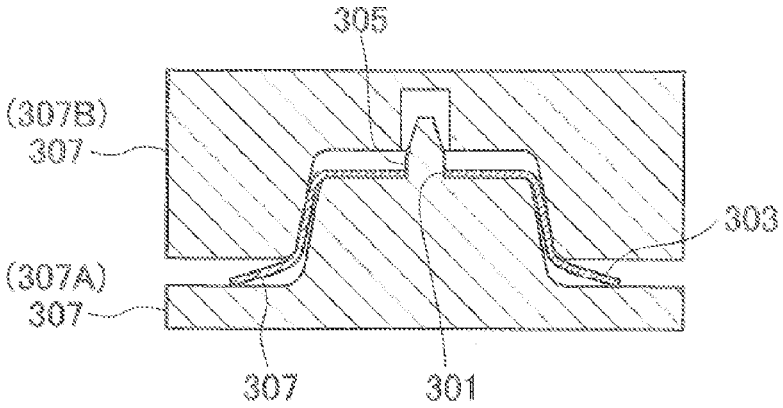
Figure 16C:
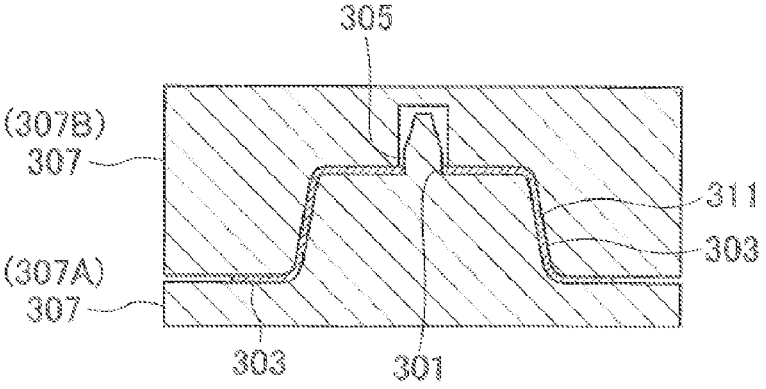

Further, as illustrated in FIG. 13A to FIG. 13C, the upper die 27B of the mold 27 may be divided into an upper die main body 51 and a bulging portion forming member 53. After the first and second side plate sections 11 and 13 and the flange sections 19 and 21 are first formed as illustrated in FIG. 13B, the top plate section 9 of the material 7 may be sandwiched in advance between the lower die 27A and the upper die main body 51, and then the bulging portion 5 may be formed by the bulging portion forming member 53.

Further, as illustrated in FIG. 14A to FIG. 15C, the lower die 27A of the mold 27 may be provided with a projecting portion 55 instead of the depressed portion 35, and the upper die 27B of the mold 27 may be provided with a depressed portion 57 instead of the projecting portion 41.

Accordingly, although not illustrated, the hot press product has a bulging portion that projects upward. In other words, the bulging portion formed in the top plate section projects in a direction opposite to the direction of projection of the side plate sections.

According to this disclosure, in the hot press product and the method of forming the hot press product by heating the material having the positioning hole formed therein, positioning and placing the heated material on the mold through engagement between the positioning pin of the mold and the positioning hole of the material, forming the material through use of the mold, and quenching the material, there is produced an effect of preventing the deformation of the positioning hole and its peripheral part that is caused in the case where the positioning hole is snagged on the positioning pin when taking the formed and quenched material (hot press product) out of the mold.

What is claimed is:

1. A method of forming a hot press product, the method comprising:

a positioning and placing step of positioning a heated material and placing the heated material on a mold through engagement between a positioning pin provided to the mold and a positioning hole provided in the heated material; and a pressing and hole expanding step of press forming the heated material through use of the mold after the heated material is positioned and placed on the mold in the positioning and placing step, and expanding the positioning hole through bulging of a peripheral part of the positioning hole of the material when the press forming is performed, wherein the bulging of the peripheral part forms a bulging portion that comprises a circular truncated cone shape portion and a bottom portion, and wherein the bottom portion is larger than the positioning hole.

2. A method of forming a hot press product according to claim 1, wherein the positioning hole comprises a plurality of positioning holes, and wherein the pressing and hole expanding step comprises bulging peripheral parts of the plurality of positioning holes.

3. A method of forming a hot press product according to claim 1, wherein the hot press product comprises a top plate section and a side plate section, the top plate section including the positioning hole formed therein, and wherein the pressing and hole expanding step comprises bending the heated material at a boundary between the top plate section and the side plate section to form the side plate section and engaging the mold with the side plate section to retain the heated material during the bulging.

* * * * *